US005997805A

United States Patent [19]

Lawcock et al.

[11] Patent Number: 5,997,805

[45] Date of Patent: Dec. 7, 1999

[54] HIGH CARBON, HIGH DENSITY FORMING

[75] Inventors: Roger Lawcock, Burlington; Peter Jones, Toronto, both of Canada

[73] Assignee: Stackpole Limited, Mississauga, Canada

[21] Appl. No.: 08/879,275

[22] Filed: Jun. 19, 1997

[51] Int. Cl.[6] ..... B22F 3/24

[52] U.S. Cl. ..... 419/28; 419/38; 419/28; 419/29

[58] Field of Search ..... 419/38, 28, 29

[56] References Cited

U.S. PATENT DOCUMENTS

| | | | |
|---|---|---|---|
| 4,018,632 | 4/1977 | Schmidt | 148/126 |
| 4,836,848 | 6/1989 | Mayama et al. | 75/231 |
| 4,913,739 | 4/1990 | Thummler et al. | 75/243 |
| 5,009,704 | 4/1991 | Banik | 75/238 |
| 5,476,632 | 12/1995 | Shiuanath et al. | 419/57 |
| 5,547,523 | 8/1996 | Blankenship, Jr. et al. | 148/677 |
| 5,754,937 | 5/1998 | Jones et al. | 419/38 |

FOREIGN PATENT DOCUMENTS

| | | |
|---|---|---|
| 1310821 | 4/1970 | United Kingdom . |
| 95/21275 | 2/1994 | WIPO . |
| 95/26421 | 3/1995 | WIPO . |
| 97/01651 | 6/1995 | WIPO . |

OTHER PUBLICATIONS

Database WPI Section Ch, Week 8847 Derwent Publications Ltd., London, G.B. Class M22, AN 88–336390 XP002082034 May 15, 1988.

*Primary Examiner*—Daniel J. Jenkins
*Attorney, Agent, or Firm*—Eugene J.A. Gierczak

[57] ABSTRACT

A manufacturing method is provided for the production of high density, high carbon, sintered powder metal steels. The composition consists of iron based powder, graphite, lubricant, and possibly at least one alloying element from the group of chromium, copper, manganese, molybdenum, nickel, niobium or vanadium. The composition is compacted in rigid tools, sintered and during cooling an isothermal or slow cooling treatment is introduced between 650° C. and 750° C. The isothermal or slow cooling treatment may alternatively be applied during a heat treatment cycle that is carried out after a conventional sintering cycle. The material processed as described may then be formed to high density. Forming to high density is not practical with high carbon materials that have been processed by conventional methods. The high density article is then heat treated in a manner to suit specific product requirements. The mechanical properties achieved by the claimed process offer significant benefits when compared to conventionally processed sintered powder metal articles.

30 Claims, 12 Drawing Sheets

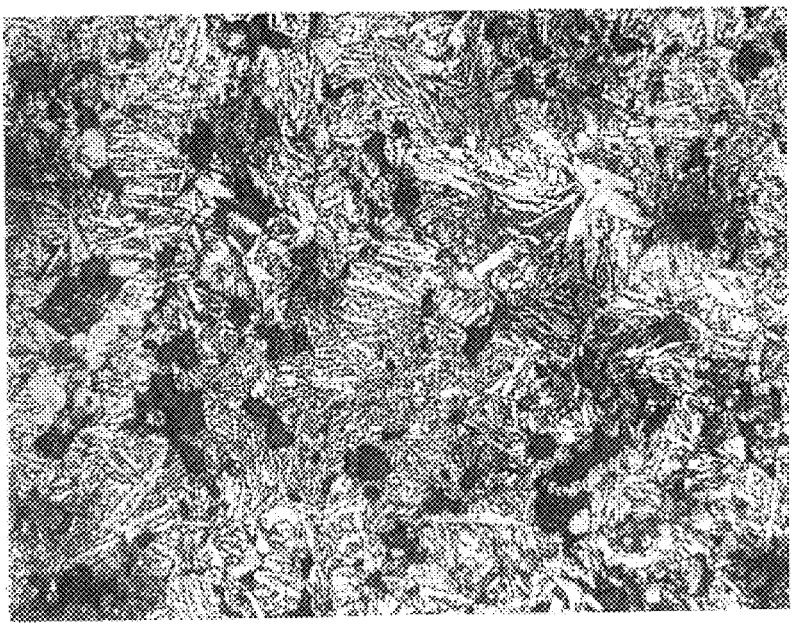
Figure 7 : Microstructure of a 0.6 wt% carbon 0.5 wt% molybdenum material after conventional cooling from sintering temperature.
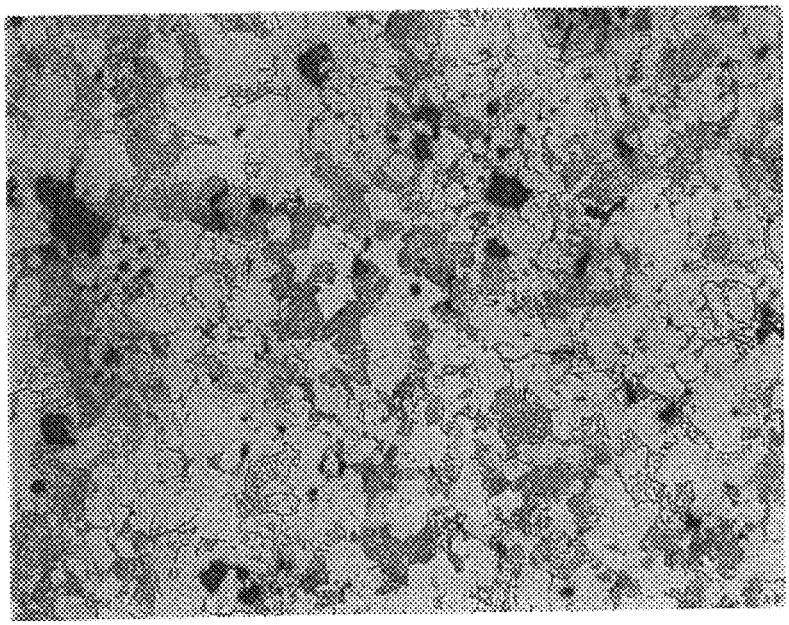
Figure 8 : Microstructure of a 0.6 wt% carbon 0.5 wt% molybdenum material after the modified cooling with an isothermal hold.

| | High Density Formed 0.6 wt%C 0.5wt%Mo Annealed Condition | High Density Formed 0.6 wt%C 0.5 wt%Mo Heat Treated | Conventional PM Medium/High Carbon Material FC 0208* Annealed Condition | Conventional PM Medium/High Carbon Material FC 0208* Heat Treated |
|---|---|---|---|---|
| Tensile Strength, ksi | 105 | 290 | 75 | 105 |
| Yield Strength, ksi | 85 | 285 | 65 | |
| Elongation, % | 8 | 1 | 1 | <0.5 |
| Elastic Modulus, psi | 25,500,000 | 25,500,000 | 22,500,000 | 21,500,000 |
| Hardness | 92 HRB | 52 HRC | 84 HRB | 43 HRC |
| Density, g/cc | 7.5 | 7.5 | 7.2 | 7.1 |

* Metal Powder Industries Standard Designation From MPIP Standard 35 1994 Edition

FIGURE 11

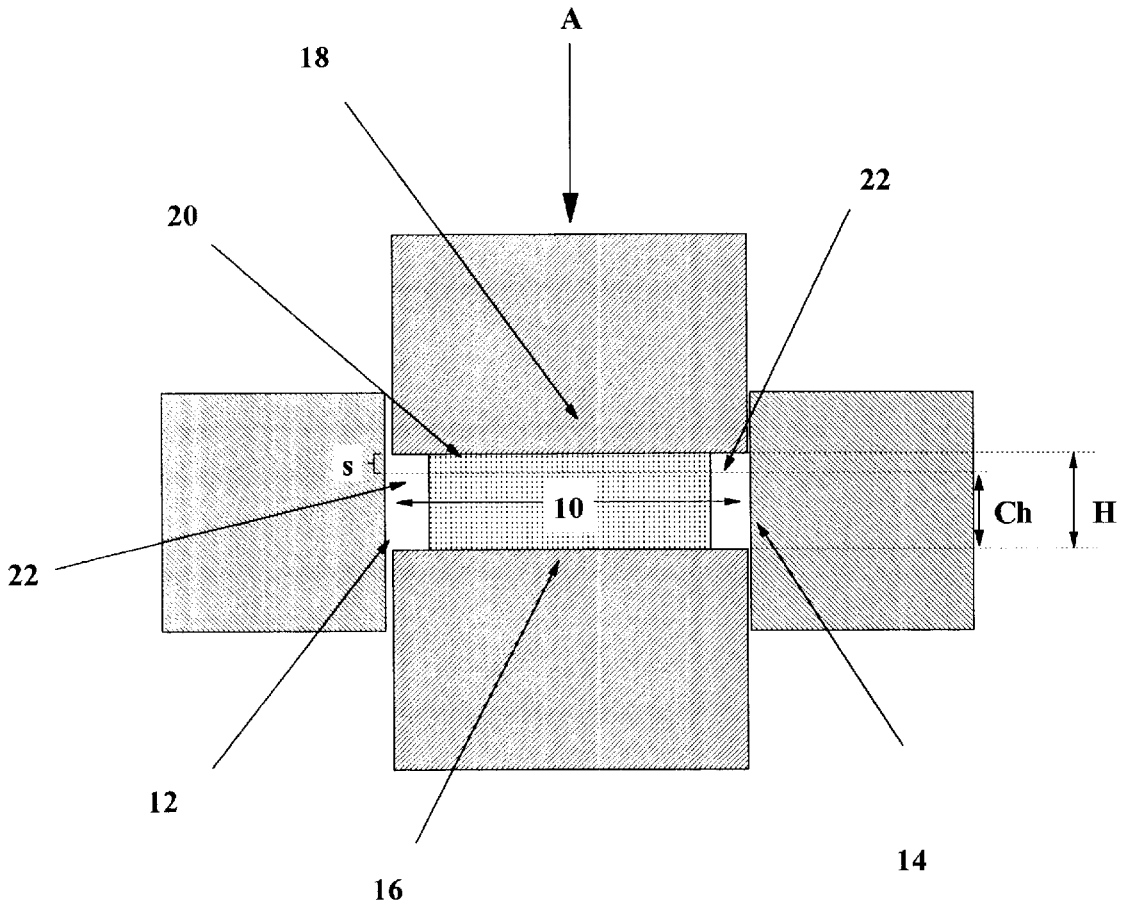
Figure 12 : Cross sectional view of the forming process.

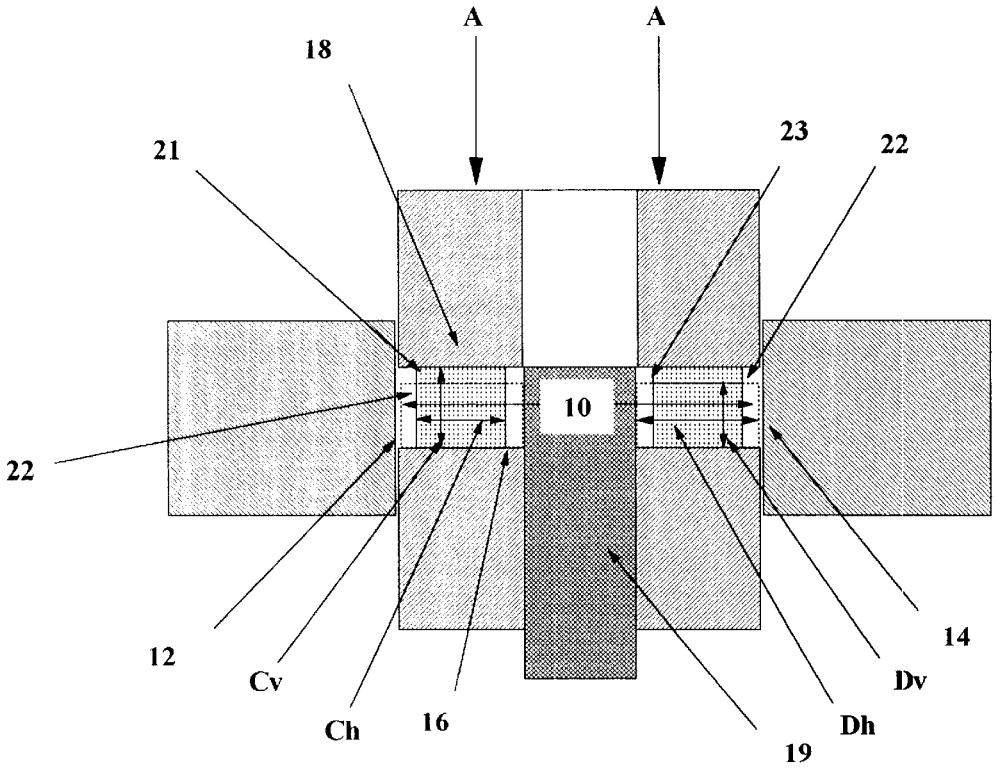
Figure 13 : Cross sectional view of the forming process for a sintered ring.

HIGH CARBON, HIGH DENSITY FORMING

FIELD OF THE INVENTION

The invention relates to manufacturing methods that allow the forming of high carbon sintered powder metal steel compacts to high density at ambient temperature. The invention relates to specific thermal treatments that must be applied prior to the forming operation. The invention further relates to specific compositions of iron based powder blends that may be used in the manufacture of the high density article.

BACKGROUND OF THE INVENTION

In previous patent applications namely U.S. patent application Ser. No. 08/644,978 filed May 15, 1996 and PCT application PCT/CA/96/00879 filed Dec. 24 1996, methods have been disclosed for the manufacture of high density powder metal articles that may contain up to 0.5% of carbon by weight. In some applications, a higher carbon content is desirable, together with high density in order to achieve specific mechanical property requirements.

Because carbon additions to iron increase hardness and reduce ductility, high density forming of higher carbon materials is usually not practical. However, in this invention, a method has been determined whereby combined selection of material composition, and thermal processing methods, can produce high carbon materials of a formable nature. High carbon materials processed in the prescribed manner to be described herein are of significantly lower hardness than usually expected, and offer advantageous forming characteristics that can be used to produce high density powder metal articles.

Forming as defined herein includes:

(a) sizing—which may be defined as a final pressing of a sintered compact to secure a desired size or dimension;

(b) coining—which can be defined as pressing a sintered compact to obtain a definite surface configuration;

(c) repressing—which can be defined as the application of pressure to a previously pressed and sintered compact, usually for the purpose of improving physical or mechanical properties and dimensional characteristics;

(d) restriking—additional compacting of a sintered compact.

In carbon containing powder metal steels that are processed in the normal manner, FIG. 1 illustrates that as carbon content is raised, the density achieved on cold forming is significantly reduced. For example, FIG. 1 shows that at the 60 tons per square inch forming pressure, a sintered part with 0.2% carbon, a density of approximately 7.5 g/cc would be achieved. With 0.6% carbon, at the same forming pressure, a density of only 7.3 g/cc would be achieved.

It is an object of this invention to provide an improved method to produce powder metal parts having improved formability at higher carbon contents.

This invention details methods of processing high carbon materials in a manner that minimizes the above reduction in formability that is usually experienced at higher carbon contents.

SUMMARY OF THE INVENTION

The invention describes methods of manufacturing higher carbon powder metal compacts that are suited to forming to high density in the range of 7.4 to 7.7 g/cc. The compositions of the final articles are of a medium to high carbon steel distinction wherein the carbon content is between 0.4% to 0.8% by weight, and preferably about 0.6% depending upon the requirements of the finished article. The forming operation is carried out at ambient temperature (although elevated temperatures could be used) which provides acceptable forming tool life and excellent precision features.

The process preferably uses low cost iron powders which are blended with calculated amounts of graphite and lubricant, calculated amounts of ferro alloys may also be added such that the final desired chemical composition is achieved. The powder blend is suited to compaction in rigid compaction dies whereby the powder blend will be pressed into a compact that is around 90% of theoretical density. The process is generally described in U.S. Pat. No. 5,476,632. Sintering of the ferroalloy compositions is undertaken at high temperatures, generally greater than 1250° C. such that oxides contained within the compact are reduced.

The benefits of the invention may also be arrived at by using prealloyed, partially prealloyed or elemental blends of metal powders that contain elements either individually or in combination from the group of chromium, copper, molybdenum, manganese or nickel, either individually or in combination. Such materials can be sintered at conventional sintering temperatures of 1100° C. to 1150° C. or alternatively at higher sintering temperatures in excess of 1150° C.

On cooling from sintering temperature, in order to generate the desired formable characteristics of the high carbon containing material, it is necessary to introduce an interruption to the cooling rate. FIG. 2 shows a diagram of a typical conventional sintering furnace temperature cycle, which consists of a heating segment, a hold at sintering temperature, and a cooling segment. FIG. 3 shows a diagram of a modified temperature profile that is a feature of the invention described herein. In the modified cycle shown in FIG. 3, there is an interruption or isothermal hold during the cooling segment.

Another embodiment of the invention may include the use of a conventional sintering cycle, but then subjecting the sintered articles to a subsequent heat treatment process which includes a heating segment, a holding segment that is usually at a lower temperature than the sintering temperature, and a cooling segment that includes an isothermal hold segment, all of which is illustrated in FIG. 4.

Such isothermal treatments as described above are well documented in the wrought steel processing industries. However the application of these processes to powder metal articles in a manner to allow subsequent forming to high density, have not been previously disclosed.

After the above modified thermal processing, the high carbon sintered powder metal article is suitable for forming to high density as described in U.S. patent application Ser. No. 08/644,978.

DRAWINGS

FIG. 7 shows the microstructure of sintered part after conventional cooling.

FIG. 8 shows the microstructure which relates to the modified cooling treatment described herein.

FIG. 11 is a graph showing mechanical property comparison.

FIG. 12 is a cross-sectional view of the forming process.

FIG. 13 is a cross-sectional view of the forming process for a sintered ring.

DETAILED DESCRIPTION OF THE INVENTION

Figure 1:
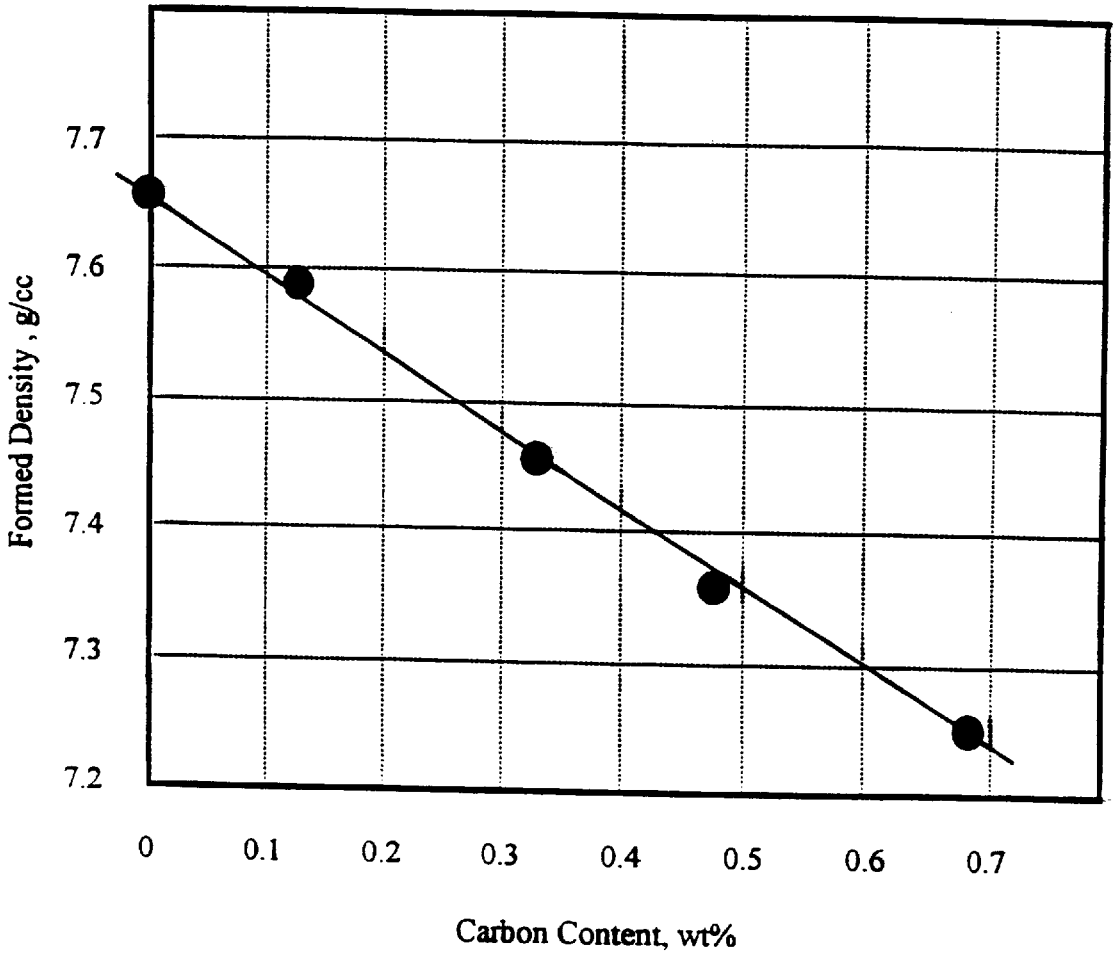
FIG. 1 is a chart illustrating the effect of carbon on formed density with test rings formed at 60 tsi.

A method of manufacturing a high carbon sintered powder metal article, suited to forming to high density is herein described. The invention involves medium to high carbon steel compositions that after the described thermal processing, may be formed to high density at ambient temperature.

More particularly, the medium to high carbon steel compositions utilized herein is between 0.4% and 0.8% by weight carbon, and preferably between 0.6 and 0.7% by weight of the final article. The actual carbon content employed depends upon the desired mechanical properties of the final sintered article. In one embodiment, the remaining composition of the article may be essentially iron and unavoidable impurities.

The manufacturing method described herein can also be applied to a broad range of alloy compositions as required. The commonality in the invention for the various compositions resides in the thermal processing that can be applied to the wide range of compositions with the objective of providing a high carbon containing material (i.e. 0.4% to 0.8% by weight) that is suited to forming to high density by the process described in U.S. patent application Ser. No. 08/644,978 and PCT/CA96/00879.

In addition to carbon, the presence of other alloying elements may be required, such as, chromium, copper, manganese, molybdenum, and nickel. These alloying elements may be present either individually or in combination in a manner to achieve the desired mechanical and metallurgical requirements of the final article.

In one embodiment the preferred method of adding chromium, manganese and molybdenum would be to add these as ferro alloys (i.e. ferro chromium, ferro manganese, and ferro molybdenum) to the base iron powder as described in U.S. Pat. No. 5,476,632, which is incorporated hereby by reference.

The ferro manganese, ferro chromium, and ferro molybdenum may be used individually with the base iron powder, or in any combination, such as may be required to achieve the desired functional requirements of the manufactured article. In other words one, two or three separate ferro alloys could be used or three ferro alloys can be blended with the base iron powder. Examples of such base iron powder includes Hoeganaes Ancorsteel 1000/1000B/1000C, Quebec Metal Powder sold under the trade marks QMP Atomet 29 and Atomet 1001.

The base iron powder composition consists of commercially available substantially pure iron powder which preferably contains less than 1% by weight unavoidable impurities. Additions of alloying elements are made to achieve the desired properties of the final article. Examples of compositional ranges of alloying elements that may typically be used include at least one of the following: 0.4 to 0.8% carbon, 0 to 1.5% of manganese, 0 to 1.5% chromium and 0 to 1.5% of molybdenum where the % refers to the percentage weight of the alloying element (apart from carbon) to the total weight of the sintered product and the total weight of the alloying elements is between 0 to 2.5%. The reference to 0% refers to the situation where there is 0% of the alloying elements Mn, Cr, Mo but between 0.4 to 0.8% carbon. The alloying elements Mn, Cr, and Mo are added as ferro alloys namely FeMn, FeCr, FeMo. The particle size of the iron powder will have a distribution generally in the range of 10 to 350 $\mu$m. The particle size of the alloying additions will generally be within the range of 2 to 20 $\mu$m. To facilitate the compaction of the powder a lubricant is added to the powder blend. Such lubricants are used regularly in the powdered metal industry. Typical lubricants employed are regular commercially available grades of the type which include, zinc stearate, stearic acid or ethylene bistearamide.

Nickel and molybdenum content may be achieved by using prealloyed grades of powder.

Prealloyed molybdenum powder metal having molybdenum compositions of 0.5% to 1.5% with the remainder being iron and unavoidable impurities can be used. Prealloyed molybdenum powder metal is available from Hoeganaes under the designation Ancorsteel 85HP (which has approximately 0.85% Mo by weight) or Ancorsteel 150HP (which has approximately 1.50% by weight Mo) or Quebec Powder Metal under the trademarks QMP at 4401 (which has approximately 0.85% by weight Mo). The particle size of the prealloyed molybdenum powder metal is generally within the range of 45 $\mu$m to 250 $\mu$m typically. The same type lubricants as referred to above may be used to facilitate compaction.

An example of prealloyed molybdenum powder which is available in the market place is sold under the designation of QMP AT 4401 which can have the following physical and chemical properties:

| | |
|---|---|
| Apparent density | 2.92 g/cm$^3$ |
| Flow | 26 seconds/50 g |
| Chemical analysis | |
| C | 0.003% |
| O | 0.08% |
| S | 0.007% |
| P | 0.01% |
| Mn | 0.15% |
| Mo | 0.85% |
| Ni | 0.07% |
| Si | 0.003% |
| Cr | 0.05% |
| Cu | 0.02% |
| Fe | greater than 98% |

Copper and nickel contents may be achieved by suitable additions of elemental powders of copper and nickel to the base iron powder. Such elemental powders are available in the marketplace and contain trace elements and unavoidable impurities.

Alternatively, copper, nickel and molybdenum contents may be achieved by using partially prealloyed grades of powder, for example grades of the type supplied by Hoeganaes, under the designation of Distaloy.

The formulated blend of powder containing powders of either iron, prealloyed iron, or partially prealloyed iron, together with carbon (which is usually added as graphite), ferro alloys if required, and lubricant, will be compacted in the usual manner as described by pressing in rigid tools.

Compacting pressures around 40 tons per square inch are typically employed to produce a green compact with a density of approximately 90% of the theoretical density of wrought steel. Full theoretical density of wrought steel is 7.86 g/cc.

The compacted article is then sintered either at conventional temperatures for prealloyed and partially prealloyed iron which are in the range of 1100° C. to 1350° C. Sintering the base iron powder with ferro alloys is conducted at high temperature sintering generally greater than 1250° C. as described in U.S. Pat. No. 5,476,632. During the sintering process, a reducing atmosphere will be maintained, or a vacuum, to ensure reduction of oxides within the compact during exposure to the elevated temperature. During cooling from the sintering temperature, when the temperature approaches approximately 700° C., an isothermal hold is introduced. The precise temperature of the isothermal hold depends on the carbon content and alloy composition of the material being processed. Generally, the isothermal hold will be in the range of 680° C. to 700° C., although for some alloys, the isothermal hold may need to be within the temperature range of 650° C. to 750° C.

The duration of the isothermal hold will be within the range of 20 minutes to two hours, depending upon carbon content, alloy composition, and the type of component that is being manufactured.

Figure 5:
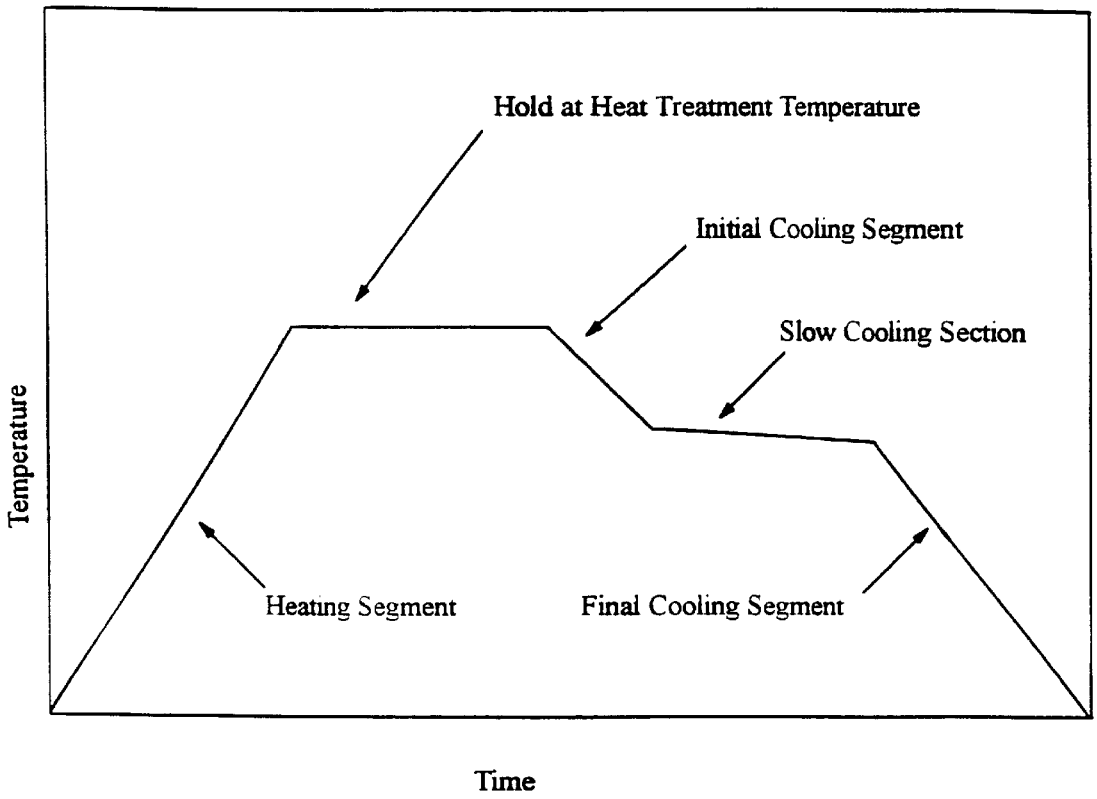
FIG. 5 is a diagram of an alternative temperature cycle that includes slow cooling in the critical temperature range.

In one embodiment the isothermal hold technique is the preferred method of achieving the required metallurgical condition prior to the high density forming operation described in U.S. patent application Ser. No. 08/644,978 and PCT/CA96/00879. However acceptable results may also be achieved by introducing a significantly slower cooling rate section during the generally faster cooling rate from either the maximum sintering temperature or the maximum heat treatment temperature, such a thermal cycle is shown in FIG. 5.

Figure 6:
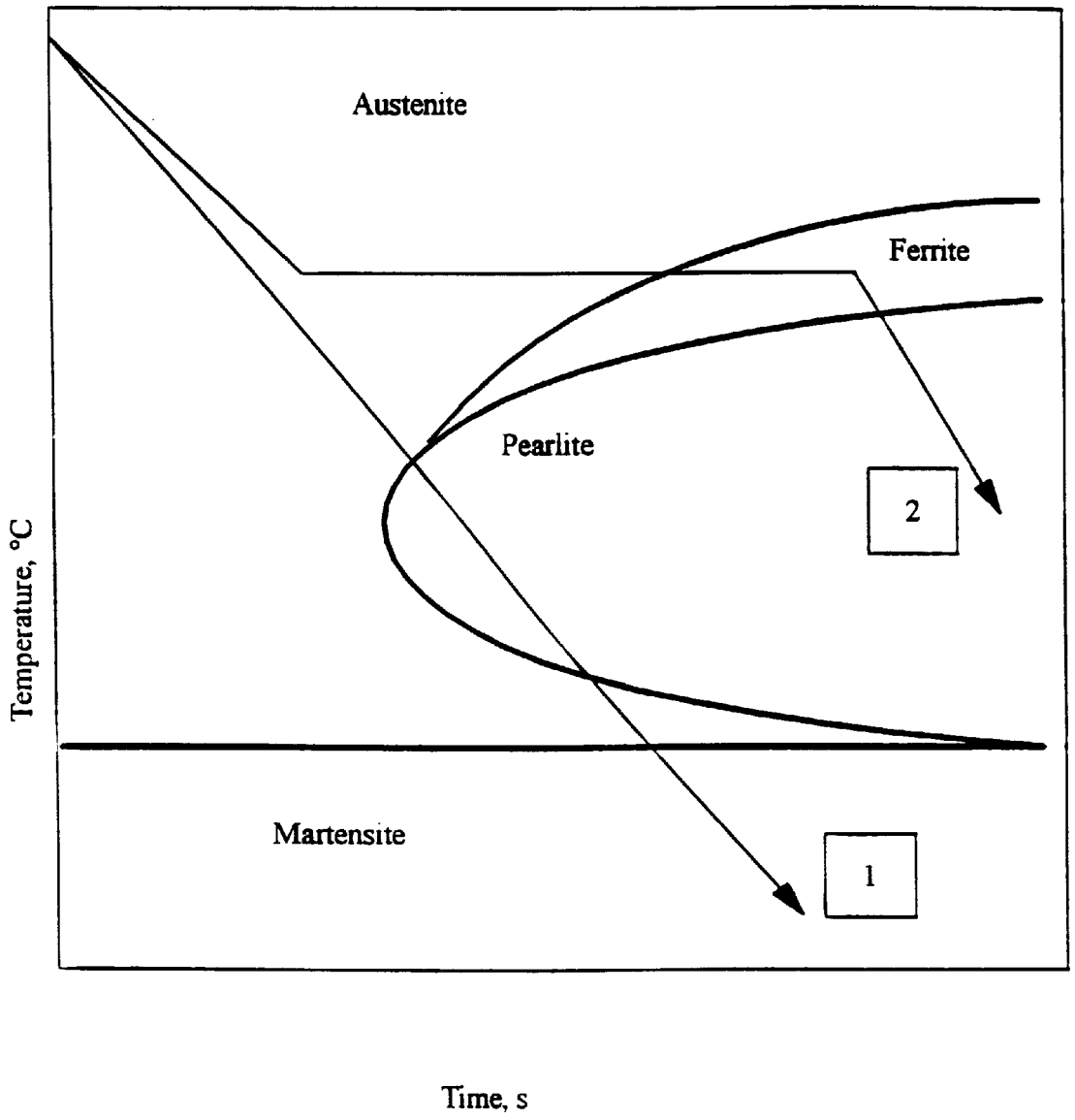
FIG. 6 is an idealised isothermal transformation diagram.

The specific reason for the isothermal hold is to produce a metallurgically desirable microstructure in the high carbon containing material such that the material is suited to a subsequent high density forming operation. FIG. 6 shows an idealized isothermal transformation diagram for a steel. The exact form of the diagram changes with each specific composition of steel. However FIG. 6 illustrates one of the features of the diagram together with the effect of cooling rate and the isothermal hold on the microstructure that will be produced in the finally cooled article. On conventional cooling from sintering or heat treatment temperatures, the cooling rate is essentially linear as shown by cooling path "1" on FIG. 6. With a high carbon material, of say 0.6% by weight, the resulting microstructure would consist of essentially pearlite, a small amount of other transformation phases may be present depending upon actual carbon content, alloy content and precise cooling rate. Such a microstructure, as shown in FIG. 7, is relatively hard. Moreover, the microstructure shown in FIG. 7 will not give high density during a subsequent high density forming operation. In other words, a pearlic structure as shown in FIG. 7, although useful, is not sufficiently ductile or malleable. However, if the modified cooling method is used, as shown by path "2" on FIG. 6, a remarkably different microstructure is achieved from exactly the same high carbon material. The isothermal hold temperature, and time duration, are selected such that during cooling of the material, a residence time is achieved in the ferrite region of the isothermal transformation diagram. The result is that in the finally cooled article, a much greater proportion of ferrite, which is very soft, is present, which provides a microstructure in a high carbon material that is well suited to a subsequent high density forming operation. Accordingly by utilizing the isothermal hold technique disclosed herein one controls the transformation to maximize the ferrite content. FIG. 8 shows the resultant microstructure of the same material shown in FIG. 7, but the modified cooling path was used during cooling from sintering temperature.

EXAMPLE

Carbon Molybdenum Material

An iron based 0.6% carbon, 0.5% molybdenum alloy was prepared by blending iron powder, lubricant ferromolybdenum and graphite. The blended mixture was compacted into test rings with a compacting pressure of about 40 tons per square inch to give a green density of approximately 7.0 g/cc.

Figure 9:
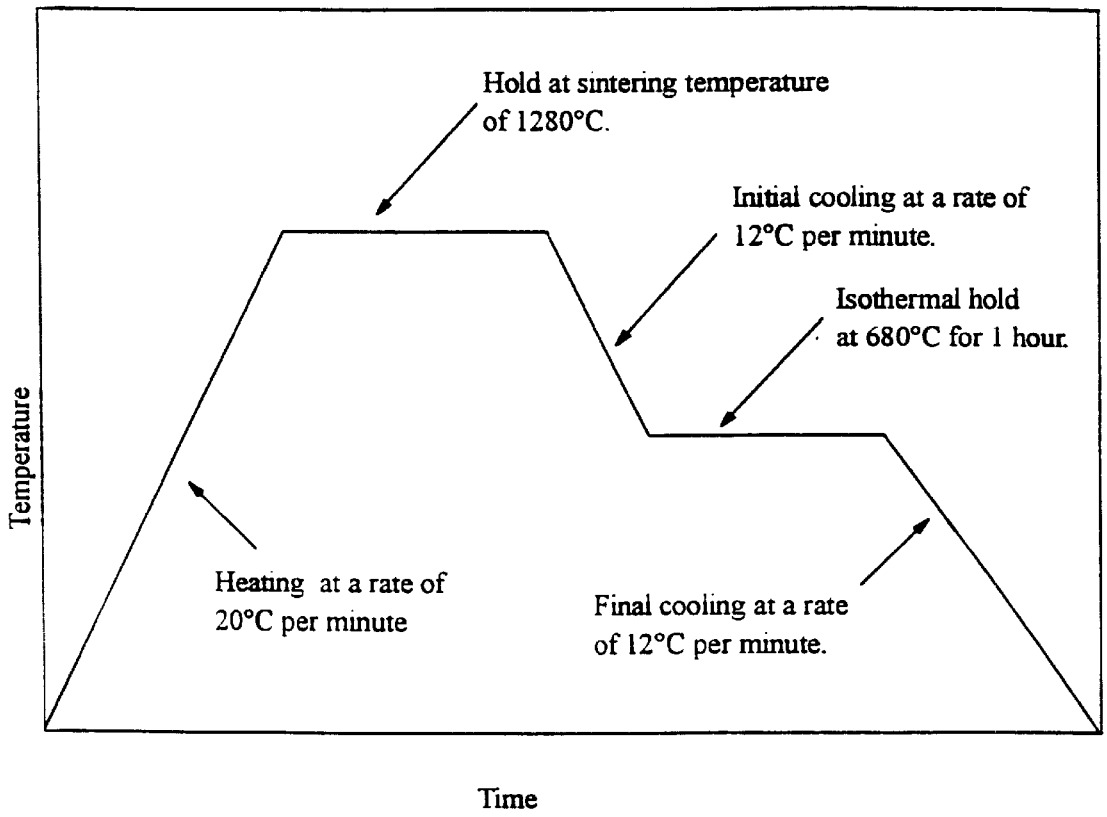
FIG. 9 is a specific thermal cycle example used with an iron, 0.6 wt % C, 0.5 wt % molybdenum alloy.

The compacted rings were then heated to sintering temperature at a heating rate of approximately 20° C. per minute, the compact was held at sintering temperature of 1280° C. for 20 minutes. The compact was cooled from sintering temperature at 12° C. per minute to 680° C. whereupon an isothermal hold was introduced at 680° C. for a time period of 60 minutes. Cooling from 680° C. was continued to ambient at 12° C. per minute. The thermal cycle is represented in FIG. 9. A nitrogen/hydrogen reducing atmosphere was maintained throughout the thermal cycle.

Figure 10:
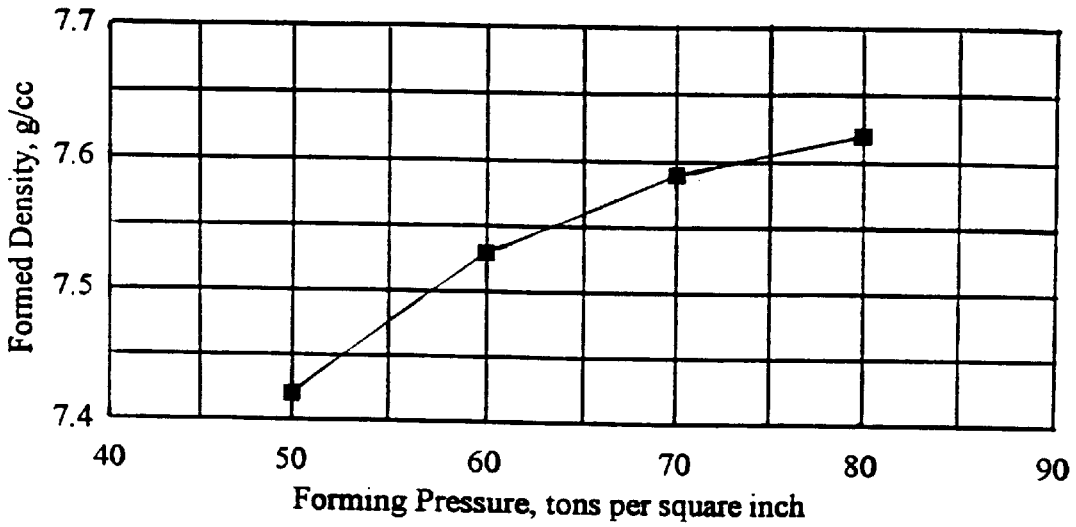
FIG. 10 is a graph showing the effect of forming pressure on formed density, Fe, 0.6 wt % C, 0.5 wt % Mo alloy.

The rings were subject to a high density forming operation as described in U.S. Pat. application Ser. No. 08/644,978 and PCT application PCT\CA\96\00879. The rings show a remarkable increase in density that cannot usually be achieved for such a high carbon containing material (0.6 % by weight). FIG. 10 shows that after forming at pressures in the range of 50 to 80 tons per square inch, densities in the range of 7.4 g/cc to 7.6 g/cc were achieved. At 60 tons per square inch a density of slightly greater than 7.5 g/cc was achieved. It should be noted that, as shown in FIG. 1, with conventional thermal cycling, with a 0.6% carbon alloy, a density of only 7.3 g/cc would be achieved after forming at 60 tons per square inch.

The mechanical properties of such a material after high density forming are shown in FIG. 11. For comparison, the mechanical properties of a conventionally processed powder metal material are given. The improvements achieved by the claimed process are clearly demonstrated.

The process described can be used with a broad range of alloying elements, which may be added to achieve specific product requirements, alloying elements from the group of, chromium, copper, manganese, molybdenum nickel, niobium and vanadium may be present either individually or in combination, together with the high carbon content, (in the range of 0.4% C by weight to 0.8% C by weight). The process can be utilized to produce a number of products, including clutch backing plates, sprockets, transmission gears and connecting rods.

Heat Treatment

Subsequent to the forming operation, in order to develop the full mechanical properties of the article, it may be necessary to subject the article to a heat treatment operation. The heat treatment operation is generally carried out within the temperature range of 800° C. and 1300° C. The conditions may be varied within the above range to suit the desired functional requirements of the specific article. It is also preferable to use a protective atmosphere during the heat treatment process. The atmosphere prevents oxidization of the article during the exposure to the elevated temperature of the heat treatment process. The actual atmosphere used may consist of hydrogen\nitrogen blends, nitrogen\exothermic gas blends, nitrogen\endothermic gas blends, disassociated ammonia or a vacuum. In the heat treatment stage it is generally preferable to maintain a neutral atmosphere in terms of carbon potential with respect to the carbon content of the article. In special circumstances, for example should the article require high wear resistance, a carburizing atmosphere may be used during heat treatment. The carburizing atmosphere may consist of methane or propane where the carbon atoms will migrate from the methane or propane to the surface layers of the article. In such an operation, carbon will be introduced into the surface layers of the article. If the article is subsequently quenched, a case hardened product can be produced with beneficial wear resistant properties.

The heat treatment process specifically causes metallurgical bonding within the densified article. After forming, there is very little metallurgical bonding between the compressed powder articles. Such a structure, while having high density, will generally not demonstrate good mechanical properties. At the elevated temperature of the heat treatment process, the cold worked structure will recrystallize and metallurgical bonding occurs between the compressed particles. After completion of the metallurgical bonding process, the article will demonstrate remarkable mechanical properties which are unusual for sintered PM articles.

After the heat treatment, the article is ready for use and will exhibit mechanical properties that are generally very similar to wrought steel of the same chemical composition.

Forming

The forming process is more fully described in U.S. patent application Ser. No. 08/644,978 and PACT/CA96/00879, but will be generally described herein.

Generally speaking, on sintering only small dimensional changes will occur. The precise extent of dimensional movement will depend on sintering conditions employed, such as temperature, time and atmosphere, and on the specific alloying additions that are made. The sintered article will be approximately 90% of theoretical density and will be of substantially the same shape as the final article. Additional processing allowances on dimensions are present and shall be more fully particularized herein.

The sintered article is then subject to the forming operation in which dimensions are bought essentially to final requirements. In other words, dimensional control is accomplished in the moving of the sintered part during forming. Furthermore it is during the forming operation in which high density is imparted to the article. The forming operation is often referred to as coining, sizing, repressing or restriking. In essence all processes are carried out in a similar manner. The commonality is pressing of a sintered article within a closed rigid die cavity. In the high density forming operation the sintered article is pressed within a closed die cavity.

The closed die cavity of the forming operation is shown in FIG. 12. The closed rigid die cavity 10 is defined by spaced vertical die walls 12 and 14, lower punch or ram walls 16 and upper punch or ram 18. The sintered part is represented by 20. During the forming operation upper punch or ram 18 imparts a compressive force to sintered part 20. Alternatively the compressive force can be imparted by relative movement between lower punch or ram wall 16 and upper punch or ram wall 18. The closed die cavity is designed with a clearance 22 to permit movement of the ductile sintered material in a direction perpendicular to or normal to the compressive force as shown by arrow A. During compression the overall compressed length or height of the sintered article is reduced by the dimension S.

Conventional coining may permit reduction or movement of the sintered material in direction A by 1 to 3%. The invention described herein permits movement of the sintered material beyond 3% of the original height or length. It is possible as shall be described herein that the reduction S or percentage closure of the sintered material can reach as much as 30% reduction of dimension H. Particularly advantageous results are achieved by having a closure which represents a compressed length or height Ch, which is between 3% to 19%, less than the original uncompressed length. In other words S represents the change in the overall height H of the sintered part to that of the compressed height Ch. Moreover, the compression of the overall length or height collapses the microstructural pores in the sintered powder metal part and thereby densifies the sintered part.

Figure 2:
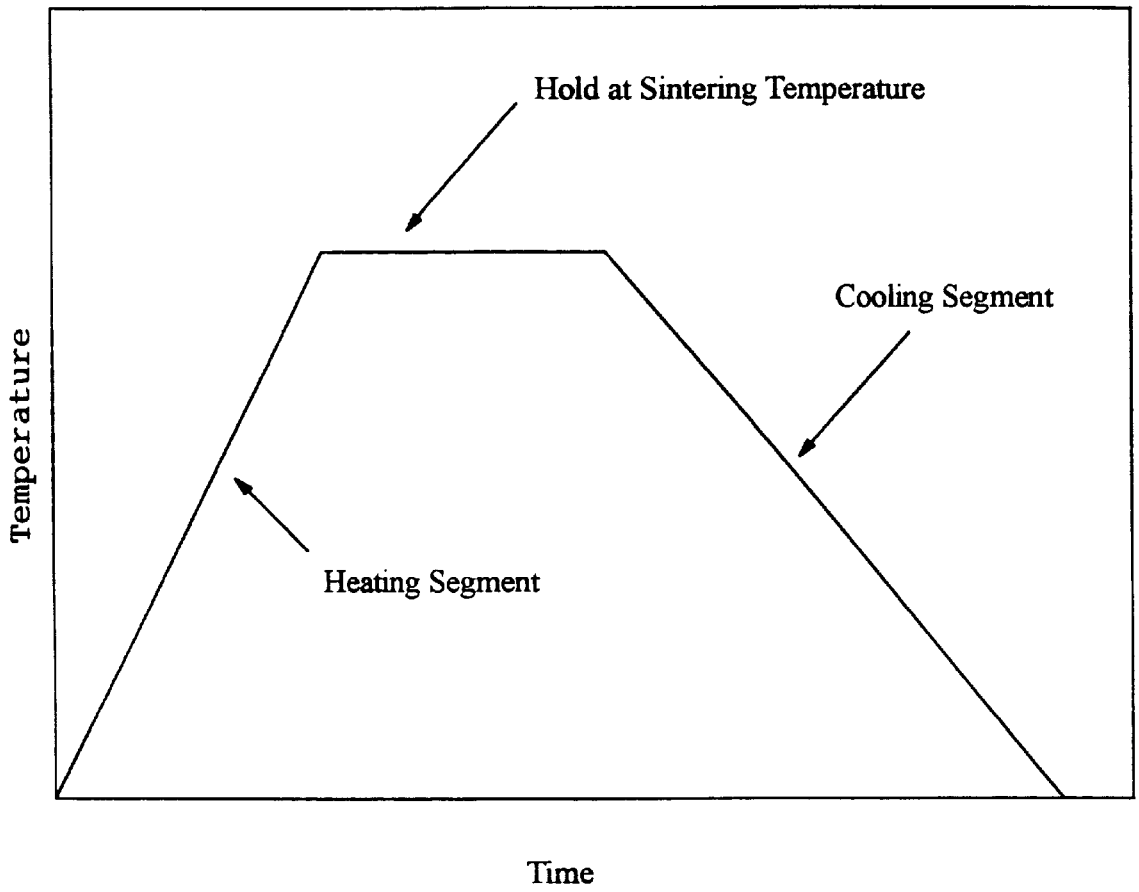
FIG. 2 is a diagram of a conventional sintering furnace temperature cycle.
Figure 3:
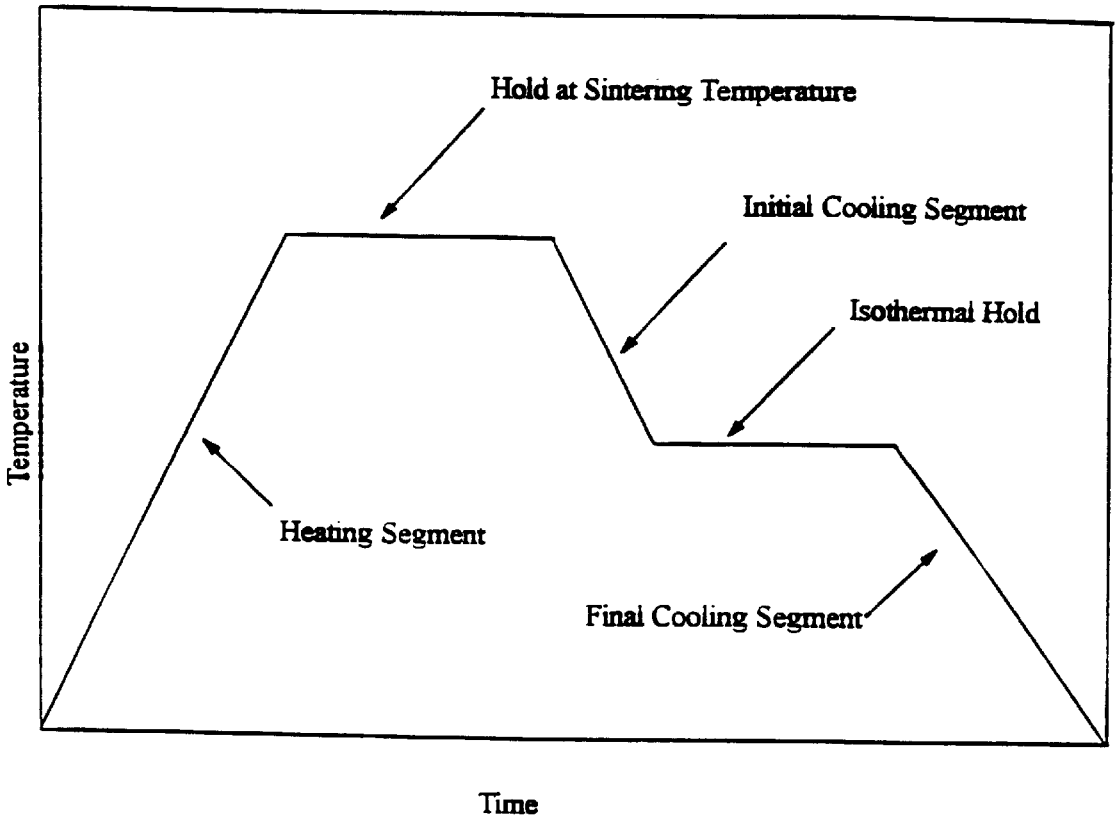
FIG. 3 is a diagram of a modified sintering furnace temperature cycle that includes an interruption during cooling.
Figure 4:
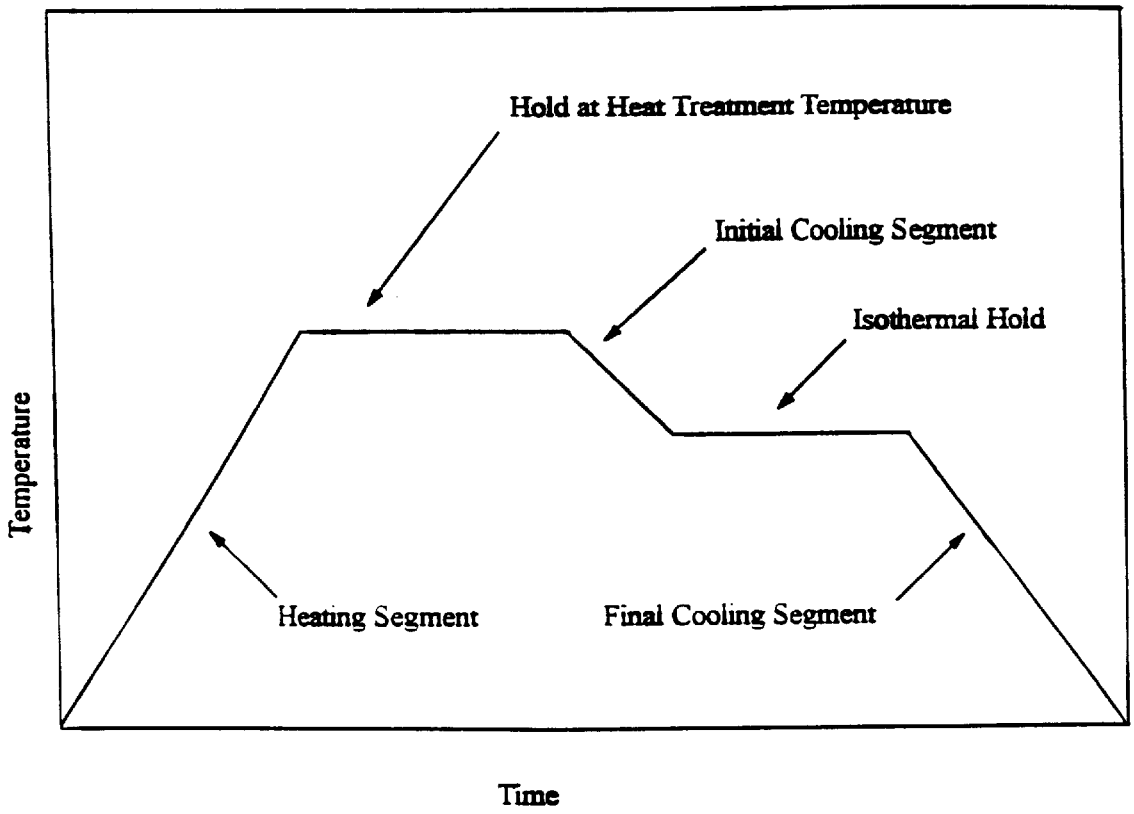
FIG. 4 is a diagram of a heat treatment temperature cycle that includes an interruption during cooling.

Another example of the closed die cavity is shown in FIG. 13 where the closed rigid die cavity 10 is again defined by the rigid tools namely spaced vertical die walls 12 and 14 respectively, the lower punch or ram wall 16 and upper punch or ram wall 18 and core 19. The core 19 moves in sliding coaxial relationship within aligned holes formed in upper punch or ram and lower punch or ram. In this case the sintered part is represented by a ring 21 which has a bore 23 therethrough. Again during the forming operation upper punch or ram 18 imparts a compressive force A to the sintered ring 21. Alternatively the compressive force can be imparted by relative movement between lower punch or ram wall 16 and upper punch or ram 18. The closed die cavity is once again designed with a clearance 22 to permit movement of ductile sintered material in a direction perpendicular or normal to the compressive force A. Once formed or compressed the sintered material will move within the closed cavity from the position of the arrows $C_v$, $C_h$ to $D_v$ and $D_h$. In other words, the sintered material will move to fill the clearance 22. Upon compression the bore 23 will have a smaller internal diameter after the application of the compressive force. The compressed height of the sintered ring 21 can be reduced by approximately 3 to 19% of the uncompressed height. In the case shown in FIG. 2, the height of the ring also represents the height is in the axial direction of the ring. In other words the sintered article is formed by axial compression allowing radial expansion to decrease the axial length of the sintered article by approximately 3 to 30% of the original axial length.

The tool clearance 22 depends on the geometry of the sintered part, and it is possible that one could have a different tool clearance 22 on the outside diameter of the part than the tool clearance on the inside diameter.

The invention described herein may be used to produce a variety of sintered powder metal powder articles or parts which have multi-levels. Examples of such are described in U.S. patent application Ser. No. 08/644,978 and PACT/CA96/00879, and include transmission sockets.

A multi-level component is comprised of the powder metal powders referred to earlier.

Although the preferred embodiments of the process have been specifically described, it should be understood that variations in the preferred embodiment could be achieved by a person skilled in the trade without departing from the spirit of the invention as claimed herein.

We claim:

1. A process of manufacturing a sintered powder metal article comprising blending powders of desired composition with lubricant and base iron powder, compacting said blended powders to shape, sintering said shaped article, then cooling said sintered article by isothermal hold or slow cooling, followed by forming said article to a density between 7.4 to 7.7 g/cc.

2. The process of claim 1, wherein the article has a carbon content within the range of 0.4% to 0.8% by weight.

3. The process of claim 2, wherein said article comprises base iron powder, with unavoidable impurities, that is blended with one or more alloying elements selected from the group of chromium, copper, manganese. molybdenum and nickel.

4. The process of claim 3, wherein said article comprises base iron powder, with unavoidable impurities, that is blended with at least one elemental powder from the group of, copper, or nickel.

5. The process of claim 3 wherein said blended powders comprises partially prealloyed iron powders, that contain at least one alloying element from the group of copper, molybdenum or nickel.

6. A process of manufacturing a sintered powder metal article comprising: heat treating a sintered powder metal steel article having a carbon content of 0.4% to 0.8% by weight carbon, said heat treatment comprising:

(i) an isothermal hold, or (ii) slow cooling of said article after sintering, within the temperature range of 650° C. to 750° C. for approximately 20 minutes to two hours, followed by forming of said article to a density between 7.4 to 7.7 g/cc.

7. A process as claimed in claim 6 wherein said forming is conducted at ambient temperatures.

8. A process as claimed in claim 7 where said sintered powder metal article includes between 0 to 1.5% Mn, 0 to 1.5% Cr, 0 to 1.5% Mo where the total weight of the alloying element of Mn, Cr, and Mo is between 0 to 2.5%, the remainder being iron and unavoidable impurities.

9. A process as claimed in claim 7 where said sintered powder metal article includes Cu and Ni.

10. A process as claimed in claim 7 wherein said sintered powder metal article is produced by blending base iron powder, graphite, lubricant with one or more ferroalloy powders from the group of ferrochromium, ferromanganese, ferromolybdenium, ferroniobium or ferrovanadium, and then compacting and sintering same at a temperature greater than 1250° C.

11. A process as claimed in claim 7 wherein said sintered powder metal article is produced by blending a prealloyed molybdenum powder metal having a molybdenum composition of between 0.5% to 1.5% by weight with the remainder being iron and other unavoidable impurities with graphite and lubricant, and then compacting and sintering same at a temperature between 1100° C. to 1350° C.

12. A process as claimed in claim 7 by sintering prealloyed grades of Ni, Cu and Mo powder having the following weight percentage:

| | |
|---|---|
| Ni | 0.0% to 4.0% |
| Mo | 0.5% to 1.5% |
| Cu | 0.0% to 3.0% |

13. A process as claimed in claim 7 wherein said sintered powder metal article is produced by blending elemental powder of Cu and Ni with base iron powder and unavoidable impurities with graphite and lubricant and then compacting and sintering same when said Cu and Ni have the following weight percentage:

| | |
|---|---|
| Cu | 0.0% to 3.0% |
| Ni | 0.0% to 4.0% |

14. A process of claim 2 wherein said forming is conducted at ambient temperature.

15. A process of claim 3 wherein said blended powders comprise base iron powder with unavoidable impurities, with one or more ferro alloy powders selected from the group of ferro chromium, ferro manganese and ferro molybdenum.

16. The process of claim 15 wherein said iron powder composition comprises substantially pure iron powder with less than 1% by weight unavoidable impurities.

17. The process of claim 3 wherein said blended powder comprises prealloyed iron base powder with one or more alloy selected from the group of nickel and molybdenum.

18. The process of claim 17 wherein said blended powder comprises prealloyed molybdenum powder having a molybdenum composition of 0.5% to 1.5% by weight with the remainder being iron and unavoidable impurities.

19. The process of claim 4, 5, 15 or 12, wherein an isothermal treatment, or a slow cooling process, is applied during cooling from sintering temperature.

20. The process of claim 4, 5, 15 or 12, wherein an isothermal treatment, or a slow cooling process, is applied during cooling in a heat treatment process that is carried out after sintering.

21. The process of claim 19, wherein said isothermal treatment, or slow cooling occurs within the temperature range of 650° C. to 750° C.

22. The process of claims 19, wherein said isothermal treatment or slow cooling occurs for a time period of between 20 minutes and 120 minutes.

23. The process of claim 22, wherein said formed article is subjected to another heat treatment process to produce the desired mechanical properties of the manufactured article.

24. The process of claim 22, wherein said article has a carbon content within the range of 0.6% to 0.7% by weight.

25. A process of producing a sintered powder metal article comprising:

(a) blending powder of a selected composition;

(b) compacting said blended powder to shape said article;

(c) sintering said shaped article;

(d) isothermally treating said sintered article;

(e) followed by forming said article to a density between 7.4 to 7.7 g/cc.

26. A process as claimed in claim 25 wherein said article has a carbon content between 0.4 to 0.8% by weight.

27. A process as claimed in claim 25 wherein said isothermal treatment comprises selecting the temperature and time duration during cooling so as to maximize ferrite content of said article.

28. A process as claimed in claim 27 wherein said isothermal treatment comprises:

(a) an isothermal hold, or (b) slow cooling treatment either as part of a sintered cooling step or second heat treatment step.

29. A process as claimed in claim 20 including a further heat treatment step after forming.

30. A process as claimed in claim 20 wherein said forming step is conducted in a closed die cavity having a clearance for movement of said sintered powder metal to final shape wherein the formed sintered powder metal article has a compressed length of 3 to 30% less than the original length.

* * * * *